US010661945B2

(12) United States Patent
Beardsell

(10) Patent No.: US 10,661,945 B2
(45) Date of Patent: May 26, 2020

(54) SPORTS AND/OR MIXING BOTTLE

(71) Applicant: ShakeSphere Products Limited, Manchester (GB)

(72) Inventor: Rick Beardsell, Manchester (GB)

(73) Assignee: ShakeSphere Products Limited (GB)

( * ) Notice: Subject to any disclaimer, the term of this patent is extended or adjusted under 35 U.S.C. 154(b) by 38 days.

(21) Appl. No.: 15/047,682

(22) Filed: Feb. 19, 2016

(65) Prior Publication Data

US 2016/0280447 A1 Sep. 29, 2016

(30) Foreign Application Priority Data

Mar. 25, 2015 (AU) ..... 2015100381

(51) Int. Cl.
*B65D 23/04* (2006.01)
*B65D 43/02* (2006.01)
(Continued)

(52) U.S. Cl.
CPC ..... *B65D 23/04* (2013.01); *B65D 43/0231* (2013.01); *B65D 47/148* (2013.01);
(Continued)

(58) Field of Classification Search
CPC .. B65D 23/04; B65D 43/0231; B65D 47/148; B65D 81/3205; B65D 25/56;
(Continued)

(56) References Cited

U.S. PATENT DOCUMENTS 1,343,299 A * 6/1920 Barrows ..... B65D 81/3283 215/6
1,744,328 A 1/1930 Morley
(Continued)

FOREIGN PATENT DOCUMENTS

CN 202516019 U 11/2012
JP H01268520 A 10/1989

*Primary Examiner* — Patrick M. Buechner
*Assistant Examiner* — Michael J. Melaragno
(74) *Attorney, Agent, or Firm* — Laubscher & Laubscher, P.C.

(57) ABSTRACT

A sports bottle is described. The bottle includes a hollow body comprising a housing having a peripheral wall, a cylindrical drink holding chamber inside the peripheral wall; a plurality of mixing chamber in fluid communication with the drink holding chamber, each one of the mixing chambers being hemispherical chambers at opposed ends of the cylindrical drink holding chamber; and an outlet for dispensing drink from the drink holding chamber, the outlet being disposed on an outside of one of the mixing chambers and in fluid communication therewith. Also described is a sports bottle including a hollow body comprising a housing having a peripheral wall, a drink holding chamber inside the peripheral wall; an outlet for dispensing drink from the drink holding chamber, the outlet being disposed on an outside of the peripheral wall and in fluid communication with the drink holding chamber, a hold for storing solid nutrition supplements, the hold comprising a plurality of supplement chambers being separated from the drink holding chamber and disposed within the peripheral wall; and a supplement chamber selector to facilitate access through the peripheral wall to a selected one or more of the supplement chambers.

14 Claims, 8 Drawing Sheets

(51) Int. Cl.
*B65D 47/14* (2006.01)
*B65D 81/32* (2006.01)
*B65D 25/56* (2006.01)

(52) U.S. Cl.
CPC ..... *B65D 81/3205* (2013.01); *B65D 25/56* (2013.01); *B65D 2543/00046* (2013.01); *B65D 2543/00092* (2013.01); *B65D 2543/00351* (2013.01); *B65D 2543/00537* (2013.01)

(58) Field of Classification Search
CPC ..... B65D 2543/00046; B65D 2543/00092; B65D 2543/00351; B65D 2543/00537
USPC .... 206/533, 538; 215/306, 372, 385, 396, 6; 221/96, 97; 222/144.5, 168.5, 171, 192, 222/562
See application file for complete search history.

(56) References Cited

U.S. PATENT DOCUMENTS 1,765,129 A * 6/1930 Cooke ..... A47J 43/27 220/568
1,969,486 A * 8/1934 Kurz ..... A47J 43/27 220/568
2,013,615 A 9/1935 Fontan
D102,943 S 1/1937 Dulany
2,072,433 A 3/1937 Solomon
D105,169 S 6/1937 Fuerst
2,752,971 A * 7/1956 Tupper ..... A47J 43/27 220/4.03
2,766,796 A * 10/1956 Tupper ..... A47G 23/03 206/216
2,774,466 A * 12/1956 Liska ..... B65D 47/263 206/538
2,791,467 A * 5/1957 Leshin ..... A47J 43/27 222/143
D186,424 S 10/1959 Oberlin
3,282,477 A * 11/1966 Henchert ..... B65D 47/103 220/258.2
3,348,716 A * 10/1967 Nakata ..... B65D 11/04 206/509
3,476,277 A 11/1969 Rownd
3,480,168 A * 11/1969 Lee ..... B65D 1/0276 215/12.2
4,288,006 A * 9/1981 Clover, Jr. ..... B65D 47/265 206/534
4,381,059 A * 4/1983 Schurman ..... A61J 7/04 116/308
4,427,123 A 1/1984 Komeda et al.
D274,040 S * 5/1984 Ridgley ..... D3/203.3
D279,864 S * 7/1985 Ridgley ..... D3/203.4
4,583,667 A * 4/1986 Fishman ..... B65D 25/04 206/538
4,691,821 A * 9/1987 Hofmann ..... A47G 19/34 206/216
4,804,101 A * 2/1989 Heath ..... A45C 11/00 206/236
4,979,629 A * 12/1990 Askerneese ..... A61J 9/001 215/11.1
5,044,512 A * 9/1991 Giancaspro ..... A47G 19/2272 215/306
5,086,926 A * 2/1992 Paige ..... A47J 41/02 206/542
5,322,166 A * 6/1994 Crowther ..... B65D 83/0454 206/534
5,386,922 A * 2/1995 Jordan ..... A01K 97/06 206/373
5,397,017 A * 3/1995 Muza ..... A61J 7/0046 206/538
D361,922 S 9/1995 Van Dyk
5,462,101 A * 10/1995 Mouchmouchian .. A61J 7/0023 141/18
5,535,889 A * 7/1996 Lin ..... A47G 19/06 206/546
5,921,394 A * 7/1999 Shroff ..... B65D 83/0454 206/533
6,119,889 A 9/2000 Fujii et al.
6,126,010 A * 10/2000 Kogen ..... A45F 3/20 206/218
6,158,607 A * 12/2000 Wallberg ..... B65D 43/0218 220/212
6,398,071 B1 * 6/2002 Fellers ..... A47F 1/08 221/174
D459,637 S 7/2002 Tardif et al.
D480,590 S * 10/2003 Linz ..... D7/300.1
D489,627 S 1/2004 Klitsner et al.
6,705,491 B1 * 3/2004 Lizerbram ..... B65D 47/265 206/221
6,820,767 B2 * 11/2004 Nicholas ..... A47G 19/2205 222/132
D499,342 S 12/2004 Klitsner et al.
6,913,165 B2 7/2005 Linz et al.
7,159,720 B2 * 1/2007 Pearson ..... B65D 83/04 206/533
7,240,795 B2 * 7/2007 Lee ..... B65D 83/0481 206/457
7,401,827 B1 * 7/2008 McGuerty ..... B65D 23/104 215/396
D604,984 S 12/2009 Kalamaras
D614,447 S 4/2010 Richau et al.
D623,460 S * 9/2010 Krasner ..... D30/132
7,954,515 B2 * 6/2011 Gerst ..... F16L 55/1141 138/89
7,959,346 B2 * 6/2011 Loden ..... A47J 43/27 220/568
D641,631 S 7/2011 Kawahara et al.
D646,919 S * 10/2011 Nilsson ..... A47J 43/27 D7/300.1
D647,497 S 10/2011 Chu
8,146,758 B1 * 4/2012 Peres ..... A61J 9/008 206/219
8,342,349 B2 * 1/2013 Lu ..... A47J 41/00 206/508
8,475,856 B2 * 7/2013 Sheehan ..... B65D 51/2857 206/219
8,499,951 B1 * 8/2013 McDonald ..... B65D 23/106 215/395
8,752,720 B1 * 6/2014 Habig ..... B65D 55/16 215/306
8,777,044 B1 * 7/2014 Raymus ..... A47G 19/2272 215/12.1
8,783,487 B2 * 7/2014 Hojo ..... B65D 1/40 206/277
D711,990 S 8/2014 Roberts et al.
8,925,768 B1 * 1/2015 Ismail ..... G01F 11/261 222/41
D724,894 S 3/2015 Brosius
9,016,488 B1 * 4/2015 Peres ..... B65D 81/3205 206/219
D739,180 S 9/2015 Beardsell
D747,148 S 1/2016 Beardsell
D748,433 S 2/2016 Kushner
D752,390 S 3/2016 Ksiazek et al.
9,427,112 B2 8/2016 Aliberti et al.
9,469,451 B2 * 10/2016 Dunn ..... A47G 19/02
D805,827 S 12/2017 Toth
D813,593 S * 3/2018 Cornu ..... D7/392
D836,985 S 1/2019 Otto
D841,381 S 2/2019 Karsten
10,301,054 B2 5/2019 Pell et al.
10,390,659 B2 8/2019 Tolman et al.
2002/0008106 A1 * 1/2002 Bezek ..... B65D 1/165 220/4.27
2004/0262306 A1 * 12/2004 Smith ..... B65D 21/0228 220/4.26
2006/0226035 A1 * 10/2006 Smith ..... B65D 25/08 206/219
2007/0138176 A1 * 6/2007 Gawlick ..... A47J 47/08 220/4.26

(56) References Cited

U.S. PATENT DOCUMENTS

2007/0221602 A1* 9/2007 Dib ..... B65D 11/04 215/6
2008/0217285 A1* 9/2008 Roth ..... B65D 23/001 215/229
2009/0178940 A1* 7/2009 Said ..... A61J 9/00 206/221
2009/0188884 A1* 7/2009 Nelson ..... A61J 9/008 215/6
2009/0236341 A1* 9/2009 McKinney ..... A47G 19/2266 220/375
2010/0200438 A1* 8/2010 Davies ..... B65D 21/083 206/223
2011/0036803 A1* 2/2011 Mejia ..... B65D 51/28 215/228
2011/0101021 A1* 5/2011 Greer ..... B65D 81/3211 222/1
2011/0108506 A1 5/2011 Lindhorst-Ko
2011/0204090 A1* 8/2011 Worthington ..... B05B 7/2443 222/144.5
2011/0278216 A1* 11/2011 Hull ..... A47G 19/2266 210/236
2012/0193316 A1* 8/2012 Starks ..... B65D 81/3205 215/6
2012/0248004 A1* 10/2012 Naghavi ..... B65D 25/04 206/538
2013/0032566 A1* 2/2013 Lee ..... C02F 1/002 215/316
2014/0091086 A1* 4/2014 Sorensen ..... A47G 19/2205 220/4.27
2014/0103037 A1* 4/2014 Strominger ..... B65D 51/28 220/23.83
2014/0183226 A1* 7/2014 Fily ..... B65D 25/20 222/143
2014/0238949 A1* 8/2014 Patel ..... B65D 21/0228 215/6
2014/0360908 A1* 12/2014 Sorensen ..... B65D 21/0228 206/501
2015/0250349 A1* 9/2015 Ng ..... A47J 43/27 215/227
2016/0280447 A1 9/2016 Beardsell
2019/0047773 A1 2/2019 Bullock et al.

* cited by examiner

SPORTS AND/OR MIXING BOTTLE

PRIORITY

The present application claims priority to Australian application number AU2015100381, filed on Mar. 25, 2015, the entirety of which is hereby incorporated by reference.

FIELD OF THE TECHNOLOGY

The present technology relates generally to sports bottles, of the kind which accompany an athlete to a workout session at a gymnasium, track or field. The bottle also has particular application to the kitchen, for mixing dressings and mixtures having suspended solids.

BACKGROUND OF THE TECHNOLOGY

Known sports and/or mixing bottles generally include a main chamber closed by a threaded closure having a centrally-disposed outlet for dispensing a drink. The outlet may include a valve or closure for controlling the drink dispensing.

To maintain very high performance, athletes consume diet and other training supplements in tablet and powder form, and when working out in high performance clothing have difficulty storing these supplements in a convenient place for consumption during training.

Some athletes mix powdered supplements into their drink bottle before a workout but with known bottles the powder is not properly mixed, and/or must be mixed too long before the athlete's workout begins, reducing its effectiveness.

This mixing of liquids with powders and mixtures having a suspended solid can also be required by chefs and home cooks in the kitchen.

The present technology seeks to provide a new sports bottle.

SUMMARY

In accordance with an aspect of the present technology there is provided a sports bottle including:

- a hollow body comprising a housing having a peripheral wall;
- a drink holding chamber inside the peripheral wall;
- an outlet for dispensing drink from the drink holding chamber, the outlet being disposed on an outside of the housing and in fluid communication with the drink holding chamber,
- a hold for storing solid nutrition supplements, the hold comprising a plurality of supplement chambers being separated from the drink holding chamber and disposed within the peripheral wall; and
- a supplement chamber selector to facilitate access through the peripheral wall to a selected one or more of the supplement chambers.

In accordance with another aspect of the present technology there is provided a sports bottle including:

- a hollow body comprising a housing having a peripheral wall;
- a drink holding chamber inside the peripheral wall;
- a plurality of mixing chambers in fluid communication with the drink holding chamber, each one of the mixing chambers being rounded chambers at opposed ends of the cylindrical drink holding chamber; and

- an outlet for dispensing drink from the drink holding chamber, the outlet being disposed on an outside of one of the mixing chambers and in fluid communication therewith.

In one embodiment one of the mixing chambers includes an upper mixing chamber, one embodiment of the upper mixing chamber being in the form of a drink chamber closure for closing the cylindrical drink holding chamber. The drink chamber closure includes a threaded lip for cooperating with a thread mounted on a lip of the drink holding chamber. In one embodiment the mixing chambers are hemispherical.

In one embodiment there is provided an outlet closure for closing the outlet. In one embodiment the outlet closure is disposed at a distal end of a strap mounted at a proximal end on an outside portion of the mixing chamber.

In one embodiment the outlet is an outlet tube disposed on the upper wall of the mixing chamber. In one embodiment the outlet tube is disposed at an offset position on the mixing chamber, opposite the proximal end mount of the strap so as to facilitate a firm hold of the closure in a closed position. It can be seen that the strap extends from a low position on the mixing chamber wall, over the top of the mixing chamber and then down onto a lower point on the short outlet tube, to maintain a slight tension on the strap.

In one embodiment the strap includes perforations to increase flexibility so that it can easily extend over the mixing chamber hemisphere and maintain its tension on the outlet closure.

In one embodiment the arrangement is such that the supplement chamber selector includes a selecting wall portion having a supplement access aperture, the selecting wall portion being adapted to move relative to one or more adjacent wall portions, so that the supplement access aperture is adapted to provide access to selected ones of the supplement chambers.

In one embodiment the drink holding chamber may be cylindrical, a square prism, a rectangular prism, so that there is one or more radiused internal walls or edges and the like to facilitate cleaning of mixed powder/fluid from the chamber.

In one embodiment the selecting wall portion is a sleeve rotatably mounted on the housing of the same radius as the peripheral wall, in use rotating about the hollow body to selectively access each one of the supplement chambers. There may be more than one supplement chamber accessed at the one time.

In one embodiment there is provided a selector closure on the supplement access aperture to control access to the supplement chambers.

In one embodiment the selector closure is a sliding door mounted on guide rails, in use sliding along the guide rails to open and close the supplement access aperture. In another embodiment the selector closure is a hinged door pivotally mounted on the selecting wall portion adjacent the supplement access aperture.

In one embodiment the supplement chambers are separated from one another by dividers. In one form the dividers are supporting gussets which support the drink holding chamber. In one embodiment there are four supporting gussets and four supplement chambers, each one in a right-angle sector extending from a mid-region of the hollow body to the selecting wall portion. In one embodiment the supplement chambers are radially adjacent a hemispherical mixing chamber to more efficiently use space while providing more efficient mixing of powders in the drink.

In one embodiment there are provided a plurality of mixing chambers in fluid communication with the drink holding chamber, each one of the mixing chambers being hemispherical chambers at opposed ends of the drink holding chamber.

In one embodiment the hemispherical chambers are provided at the top and bottom of the drink holding chamber inside the peripheral wall. In one embodiment the outlet is in fluid communication with the top mixing chamber. In one embodiment the top mixing chamber is under a closure or lid, threadably engaged to the top lip of the housing.

In one embodiment the bottle includes a sump for holding further supplements. In one embodiment the sump is disposed at the top of the bottle, on top of or under the lid, while in another embodiment the sump is part of the hold, disposed at the base of the bottle.

In one form the further supplements are in the form of powder. In one embodiment the sump is a cylindrical cup threadably connected to the hollow body, and preferably connected to the supplement chambers so as to hold the sleeve onto the hollow body.

In one embodiment the peripheral wall includes indicators of location and extent of the supplement chambers so as to facilitate selection of a supplement chamber.

In one embodiment the peripheral wall includes indicators of mass of powder and fluid level inside the sump and the drinking chamber.

Advantageously, preferred embodiments of the present invention provide a drink bottle that contains secure storage of supplement pills, car keys, and other supplementary items in a convenient way in a space that would otherwise be wasted.

Advantageously, preferred embodiments of the present invention provide effective mixing of powdered supplements in a drinking chamber by use of the top and bottom hemispherical chamber. Cleaning of the interior of the bottle is also facilitated by the top and bottom hemispherical chambers since powder does not get stuck in any corners.

Advantageously, preferred embodiments facilitate evacuation of all fluid from the drink holding chamber without having to completely invert the sports bottle due to the offset disposition of the outlet tube on the upper mixing chamber.

BRIEF DESCRIPTION OF THE DRAWINGS

In order to enable a clearer understanding, a preferred embodiment of the technology will now be further explained and illustrated by reference to the accompanying drawings, in which.

DETAILED DESCRIPTION OF A PREFERRED EMBODIMENT

Figure 1:
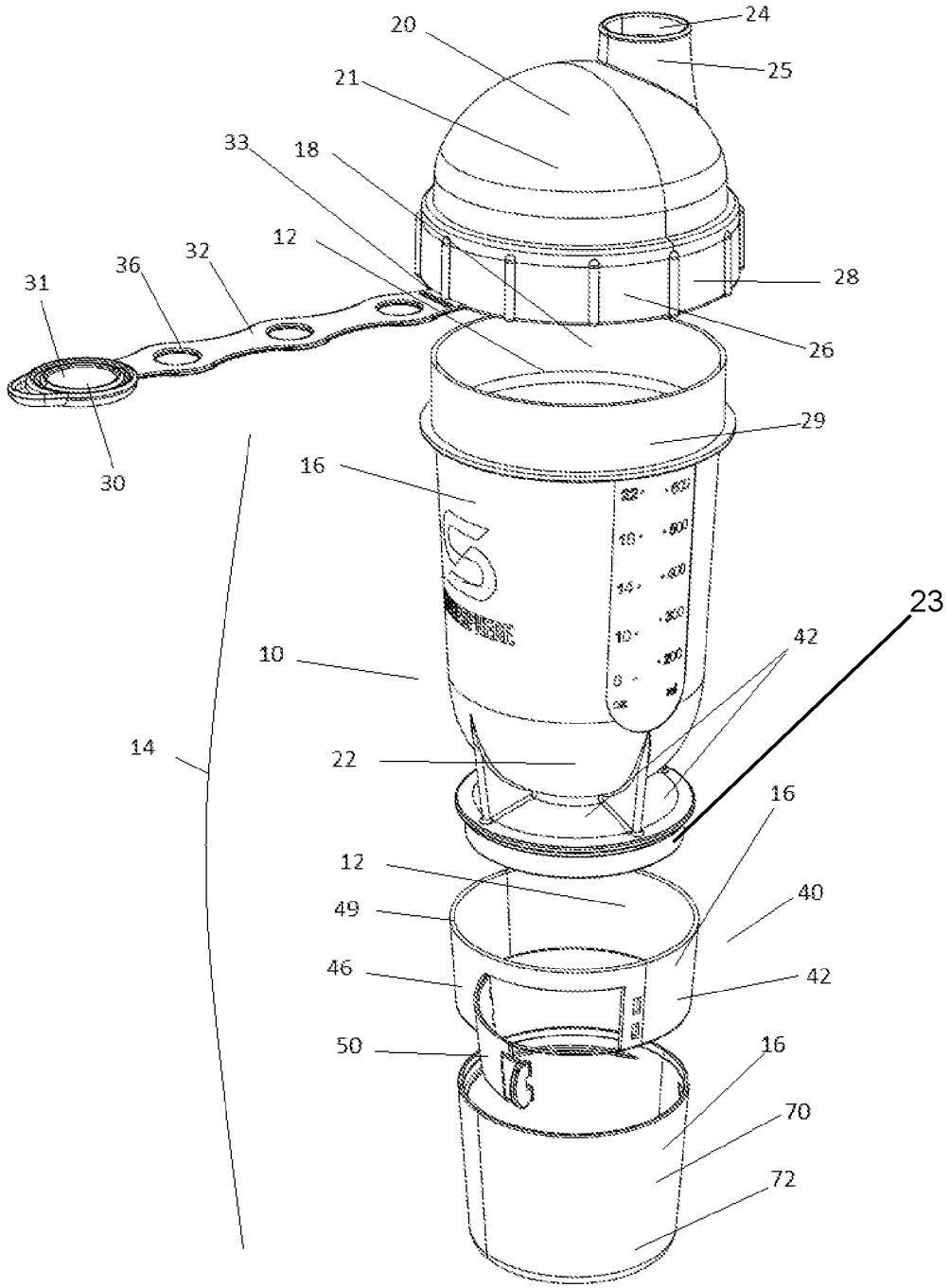
FIG. 1 is an isometric exploded view of a sports bottle in accordance with an embodiment of the present technology.
Figure 2:
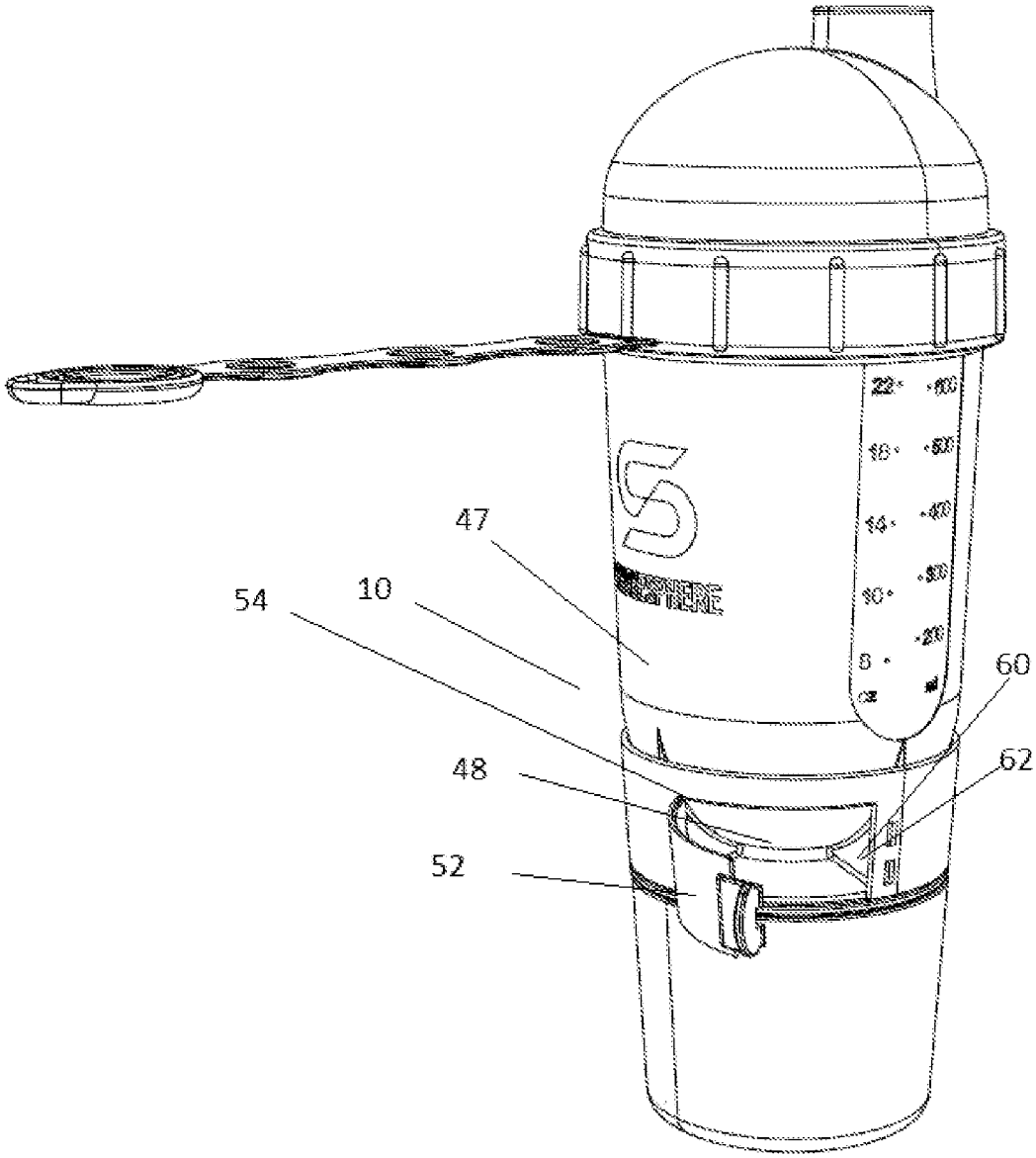
FIG. 2 is an isometric, assembled view, of the sports bottle shown in FIG. 1.
Figure 3:
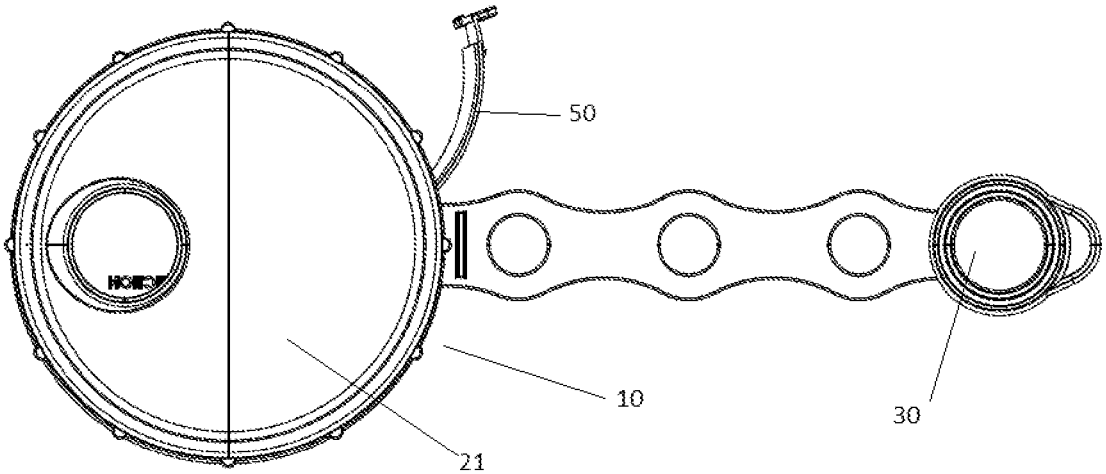
FIG. 3 is a plan view of the sports bottle shown in FIG. 1.
Figure 4:
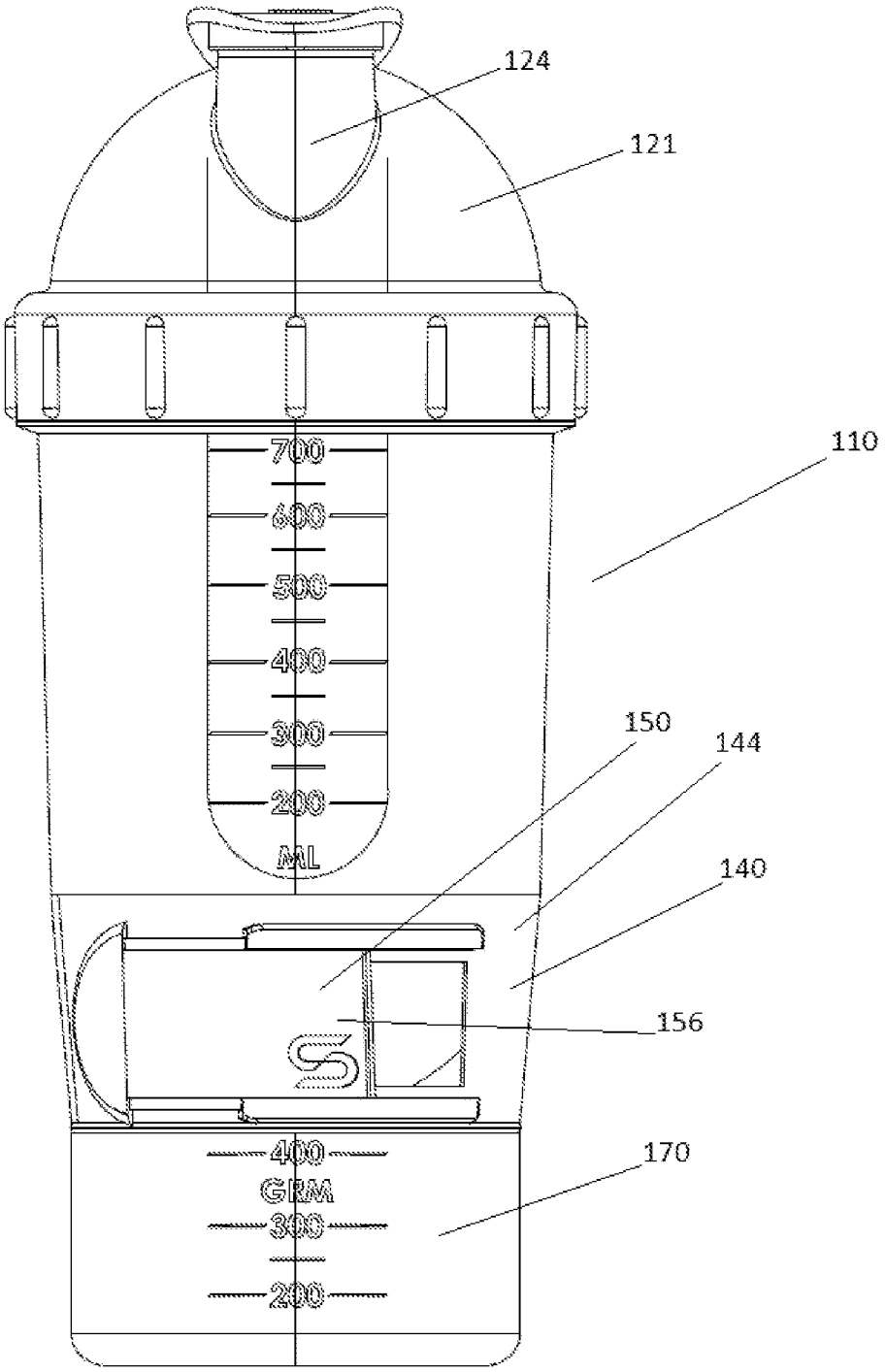
FIG. 4 is a front elevation view of another sports bottle in accordance with another embodiment of the present technology.
Figure 5:
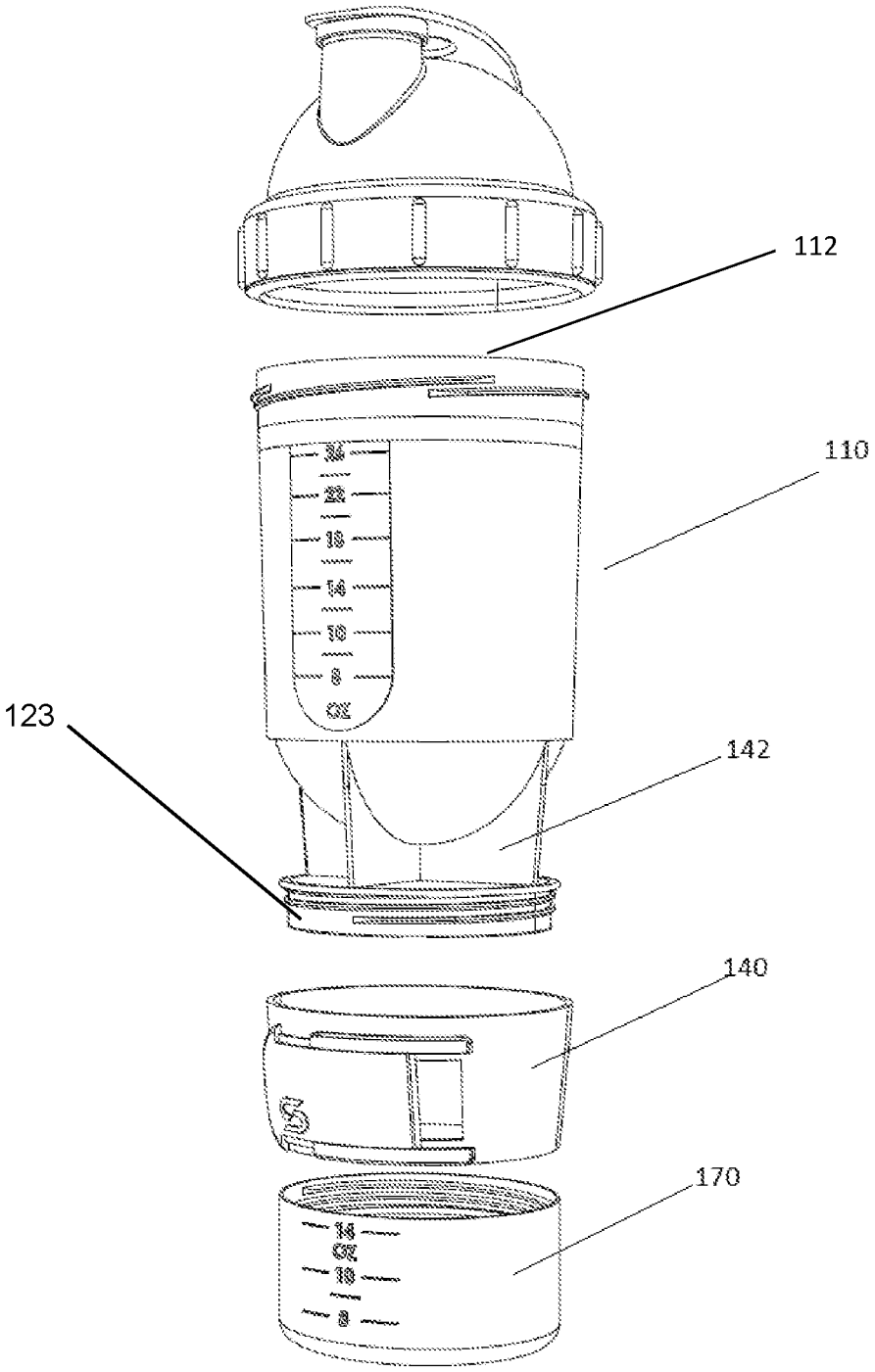
FIG. 5 is an exploded isometric view of the sports bottle shown in FIG. 4.
Figure 6:
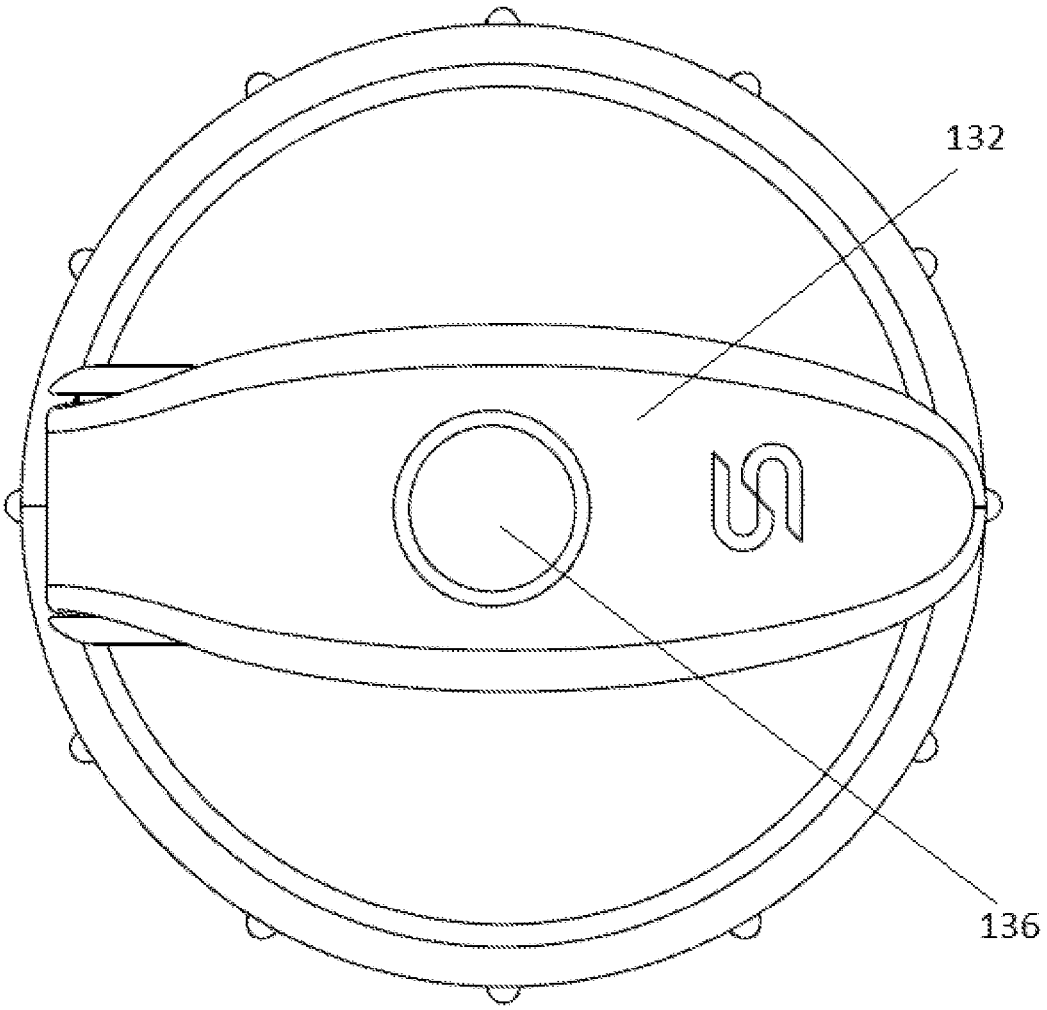
FIG. 6 is a plan view of the sports bottle shown in FIG. 4.
Figure 7:
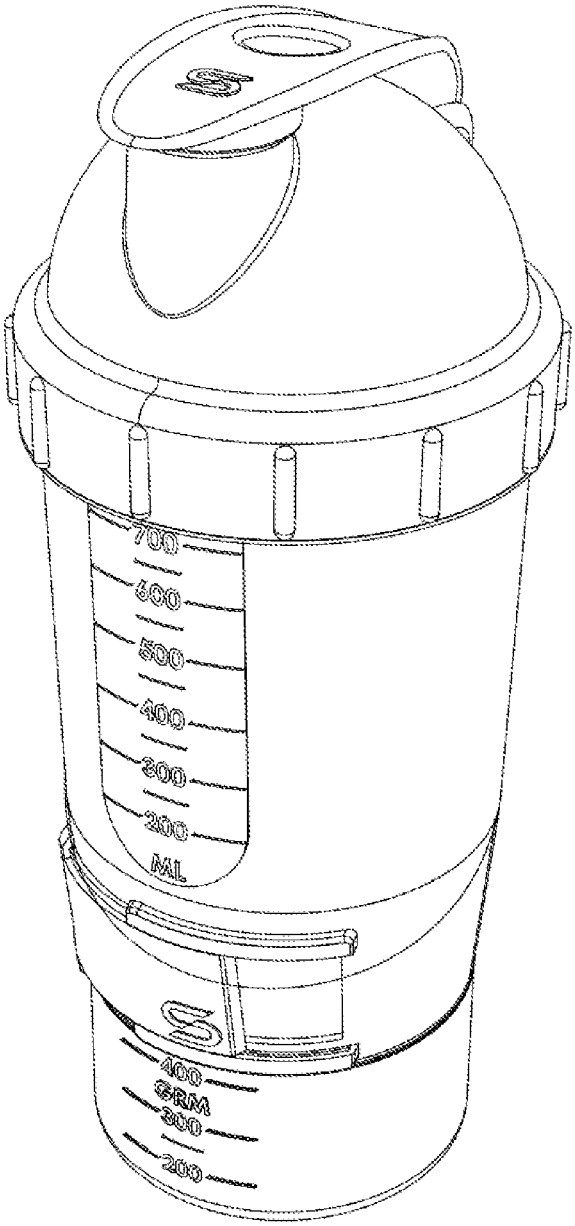
FIG. 7 is an isometric, assembled view of the bottle shown in FIG. 4.
Figure 8:
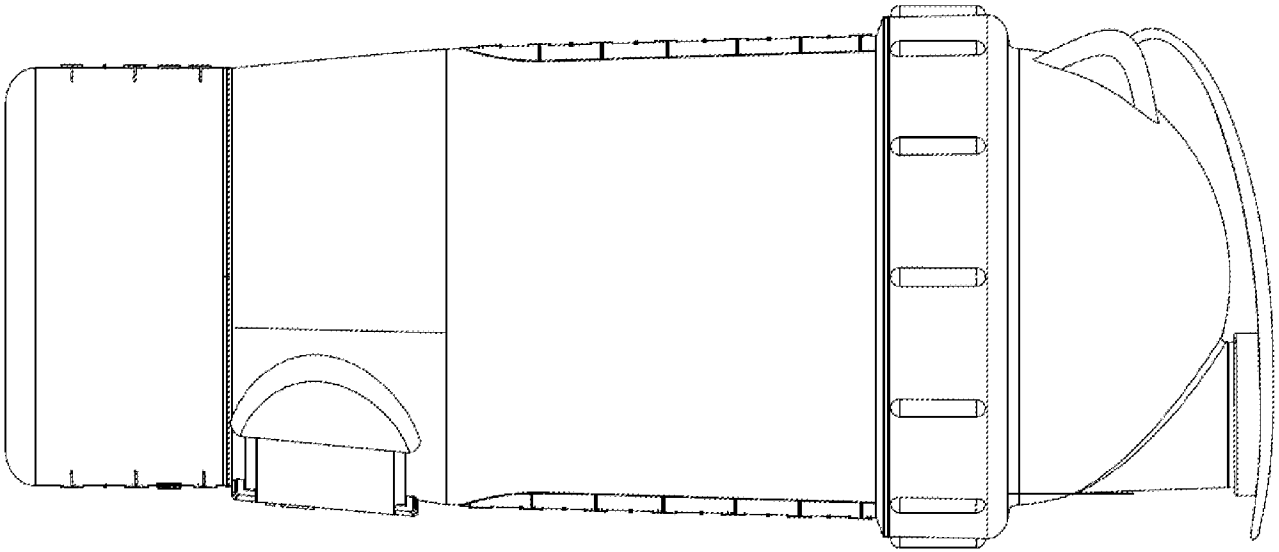
FIG. 8 is a side elevation view of the assembled bottle shown in FIG. 7.

Referring to FIGS. 1 to 3 there is shown a sports bottle generally indicated at 10, which is in accordance with an embodiment of the present technology. Throughout this description, like numerals denote like parts. Therefore, referring to FIGS. 4 to 8 there is shown another sports bottle generally indicated at 110 in accordance with an embodiment of the present technology.

The sports bottle 10, 110 includes a hollow body 12, 112 comprising a housing 14, 114 having a peripheral wall 16, 116. There is also a cylindrical drink holding chamber 18, 118 inside the peripheral wall 16, 116, a plurality of mixing chambers 20, 120 in fluid communication with the drink holding chamber 18, 118, each one of the mixing chambers 20, 120 being hemispherical chambers 21, 121 (upper) and 22, 122 (lower) at opposed ends of the cylindrical drink holding chamber 18, 118.

In the embodiment shown at FIGS. 1 to 3 there is provided an outlet 24 for dispensing drink from the drink holding chamber 18, the outlet 24 being disposed on an outside of the top mixing chamber 21 and in fluid communication therewith.

The upper mixing chamber 21 is a closure 26 for closing the cylindrical drink holding chamber 18. A fastener for the closure 26 is in the form of a thread 28 on a lip of the mixing chamber for cooperating with a thread 29 mounted on a lip of the drink holding chamber 18.

In one embodiment there is provided an outlet closure 30 for closing the outlet 24. The outlet closure 30 is disposed at a distal end 31 of a strap 32, which is mounted at a proximal end 33 on an outside portion of the mixing chamber 21.

The outlet 24 is an outlet tube 25 disposed on the outer wall of the mixing chamber 21. The outlet tube 25 is disposed at an offset position on the mixing chamber 21, opposite the proximal end mount 33 of the strap 32 so as to facilitate a firm hold of the outlet closure 30 when in a closed position. It can be seen that the strap 32 extends from a low position on the mixing chamber wall, over the top of the mixing chamber 21 and then down onto a lower point on the short outlet tube 25, to maintain a slight tension on the strap 32.

The strap 32 includes perforations 36 to increase flexibility so that it can easily extend over the mixing chamber hemisphere 21 and maintain its tension on the outlet closure 30.

The bottle 10 also includes a hold 40 suitable for storing solid nutrition supplements and other items, the hold 40 comprising a plurality of supplement chambers 42 being separated from the drink holding chamber and disposed within the peripheral wall 16.

Also provided is a supplement chamber selector 44 to facilitate access through the peripheral wall 16 to a selected one or more of the supplement chambers 42.

The arrangement in the embodiment shown in FIGS. 1 to 3 (and indeed the embodiment shown at FIGS. 4 to 8, with like, but differing numbers) is such that the supplement chamber selector 44 includes a selecting wall portion 46 having a supplement access aperture 48, the selecting wall portion 46 being adapted to move relative to one or more adjacent wall portions 47, so that the supplement access aperture 48 is adapted to provide access to selected ones of the supplement chambers 42.

The selecting wall portion 46 is a sleeve 49, forming part of the peripheral wall 16, the sleeve 49 rotatably mounted on the hollow body 12 and in use rotating about the hollow body 12 to selectively access each one of the supplement chambers 42 when required by an athlete.

There is also provided a selector closure 50 on the supplement access aperture 48 to control access to the supplement chambers 42.

The selector closure 50 is a hinged door 52 mounted on pivots 54, and in use pivots to open and close the supplement access aperture 42. In the other embodiment shown in FIGS. 4 to 8, the selector closure 150 is a sliding door 156 slidably mounted on rails 154 on the selecting wall portion 146 adjacent the supplement access aperture 148.

The supplement chambers are separated from one another by dividers 60. In one form the dividers are supporting gussets 62 which support the drink holding chamber 18. There are four supporting gussets 62 shown and four supplement chambers 42, each one in a right-angle sector extending from a mid-region of the hollow body 12 to the selecting wall portion 46. The supplement chambers 42 are radially adjacent the bottom hemispherical mixing chamber 22 to more efficiently use space while providing more efficient mixing of powders in the drink, and effective interior cleaning.

The bottle includes a sump 70 for holding further supplements. In one form the further supplements are in the form of powder. The sump 70 may be disposed in any suitable position such as under the lid 21,121, so that the outlet tube would extend through the sump 70 but in one embodiment the sump 70 is part of the hold 40 and disposed under the supplement chambers.

In one embodiment the sump is a cup 72 threadably connected to the hollow body at the base 23, 123 adjacent the supplement chambers, and connected to the supplement chambers so as to hold the sleeve onto the hollow body. In one embodiment the cup is cylindrical but could be square in section, rectangular, having radiused internal corners and edges.

The peripheral wall may be circular in section but could be square in section, rectangular in section or any suitable section with radiused internal or external edges so that cleaning of mixed material (solid/liquid) is facilitated and grip on the body by an athlete's hand is made easier.

In one embodiment the housing, the supplement chambers and the sump are all unified so that they all combine to form a cylinder, but they could equally usefully be a square prism, a rectangular prism, or other suitable shape.

The peripheral wall includes indicators of location and extent of the supplement chambers so as to facilitate selection of a supplement chamber.

The peripheral wall includes indicators of mass of powder and fluid level inside the sump and the drinking chamber.

In this specification, where a document, act or item of knowledge is referred to or discussed, this reference or discussion is not an admission that the document, act or item of knowledge or any combination thereof was at the priority date:

(a) part of common general knowledge; or (b) known to be relevant to an attempt to solve any problem with which this specification is concerned.

The word 'comprising' and forms of the word 'comprising' as used in this description do not limit the invention claimed to exclude any variants or additions.

Modifications and improvements to the technology will be readily apparent to those skilled in the art. Such modifications and improvements are intended to be within the scope of this technology.

Additional Disclosure

71. A sports bottle including:

a hollow body comprising a housing having a peripheral wall, a drink holding chamber inside the peripheral wall;

an outlet for dispensing drink from the drink holding chamber, the outlet being disposed on an outside of the peripheral wall and in fluid communication with the drink holding chamber, a hold for storing nutrition supplements, the hold comprising a plurality of supplement chambers being separated from the drink holding chamber and disposed within the peripheral wall; and a supplement chamber selector to facilitate access through the peripheral wall to a selected one or more of the supplement chambers.

72. The sports bottle in accordance with clause 71 wherein the supplement chamber selector includes a selecting wall portion having a supplement access aperture, the wall portion being adapted to move relative to one or more adjacent wall portions, so that the supplement access aperture is adapted to provide access to selected ones of the supplement chambers.

73. The sports bottle in accordance with clause 71 or 72 wherein a selecting wall portion is a sleeve rotatably mounted on the housing and adapted to rotate about the hollow body to facilitate selective access to each one of the supplement chambers, and wherein a selector closure is provided on the supplement access aperture to control access to the supplement chambers.

74. The sports bottle in accordance with any one of clauses 71 to 73 further including a sump for holding further supplements.

75. The sports bottle in accordance with any one of clauses 71 to 74 further including an upper mixing chamber, the upper mixing chamber being a drink chamber closure for closing the cylindrical drink holding chamber.

76. The sports bottle in accordance with any one of clauses 71 to 75 wherein the drink chamber closure includes a threaded lip for cooperating with a thread mounted on a lip of the drink holding chamber.

77. The sports bottle in accordance with any one of clauses 71 to 76 wherein the upper mixing chamber is hemispherical.

78.The sports bottle in accordance with any one of clauses 71 to 77 further including an outlet closure for closing the outlet.

79. The sports bottle in accordance with any one of clauses 71 to 78 wherein the outlet closure is disposed at a distal end of a strap mounted at a proximal end on an outside portion of the mixing chamber.

80. The sports bottle in accordance with any one of clauses 71 to 79 wherein the outlet is an outlet tube disposed on the upper wall of the mixing chamber.

81. The sports bottle in accordance with any one of clauses 71 to 80 wherein the outlet is disposed at an offset position on the mixing chamber, opposite the proximal end mount of the strap so as to facilitate a firm hold of the closure in a closed position.

82. The sports bottle in accordance with any one of clauses 71 to 81 wherein the strap extends from a low position on the mixing chamber wall, over the top of the mixing chamber and then down onto a lower point on the outlet, to maintain a slight tension on the strap.

83. The sports bottle in accordance with any one of clauses 71 to 82 wherein the strap includes perforations to increase flexibility so that it can easily extend over the mixing chamber hemisphere and maintain its tension on the outlet closure.

84. The sports bottle in accordance with any one of clauses 71 to 83 wherein the selector extends across more than one chamber so that more than one supplement chamber may be accessed at the one time.

85. The sports bottle in accordance with any one of clauses 71 to 84 wherein the selector may be a selector closure in the form of a sliding door mounted on guide rails, the sliding door configured to slide along the guide rails to open and close the supplement access aperture.

86. The sports bottle in accordance with any one of clauses 71 to 85 wherein the selector is a hinged door pivotally mounted on the selecting wall portion adjacent the supplement access aperture.

87. The sports bottle in accordance with any one of clauses 71 to 86 wherein the supplement chambers are separated from one another by dividers.

88. The sports bottle in accordance with any one of clauses 71 to 87 wherein the dividers are supporting gussets which support the drink holding chamber.

89. The sports bottle in accordance with any one of clauses 71 to 88 wherein there are four supporting gussets and four supplement chambers, each one in a right-angle sector extending from a mid-region of the hollow body to the selecting wall portion.

90. The sports bottle in accordance with any one of clauses 71 to 89 wherein the supplement chambers are radially adjacent a hemispherical mixing chamber to more efficiently use space while providing more efficient mixing of powders in the drink.

The invention claimed is:

1. A sports bottle comprising:

(a) a housing including (1) a peripheral wall defining a drink mixing and holding chamber open at its upper end, a lower portion of said peripheral wall having a hemispherical configuration;

(2) a plurality of radially spaced dividers extending from an exterior surface of said peripheral wall lower portion; and (3) a base connected with and extending from said radially spaced dividers to define a plurality of chambers between said base and said peripheral wall lower portion;

(b) a sleeve rotatably mounted on said base and enclosing said chambers, said sleeve containing an aperture for selectively accessing said chambers and including a first closure for closing said aperture;

(c) a second closure removably connected with said housing adjacent said drink holding chamber upper end, said second closure including an upper hemispherical mixing chamber and an outlet for dispensing contents from said drink mixing and holding chamber, wherein said upper hemispherical mixing chamber and said peripheral wall lower portion fluidly cooperate during a shaking action of the sports bottle to allow mixing of contents within said drink mixing and holding chamber.

2. The sports bottle in accordance with claim 1 and further comprising a sump removably connected with the base.

3. The sports bottle in accordance with claim 1 wherein said second closure includes a threaded lip for cooperating with a thread mounted on a lip about said upper opening of said drink mixing and holding chamber.

4. The sports bottle in accordance with claim 1 further including an outlet closure for closing said outlet.

5. The sports bottle in accordance with claim 4 wherein said outlet closure is disposed at a distal end of a strap mounted at a proximal end on an outside portion of said upper mixing chamber.

6. The sports bottle in accordance with claim 5 wherein said outlet is disposed at an offset position on said second closure, opposite the proximal end mount of said strap so as to facilitate a firm hold of said outlet closure in a closed position.

7. The sports bottle in accordance with claim 5 wherein said strap extends from a low position on said drink mixing and holding chamber, over the top of said second closure and then down onto a lower point on said outlet, to maintain a slight tension on said strap.

8. The sports bottle in accordance with claim 5 wherein said strap includes perforations to increase flexibility so that it can easily extend over said second closure and maintain its tension on said outlet closure.

9. The sports bottle in accordance with claim 1 wherein said outlet is an outlet tube disposed on said second closure.

10. The sports bottle in accordance with claim 1 wherein the aperture extends across more than one chamber so that more than one chamber may be accessed at the one time.

11. The sports bottle in accordance with claim 1 wherein said first closure is a sliding door mounted on guide rails, said sliding door being configured to slide along the guide rails to open and close said aperture.

12. The sports bottle in accordance with claim 1 wherein said first closure is a hinged door pivotally mounted on a wall portion of said sleeve adjacent said aperture.

13. The sports bottle in accordance with claim 1 wherein said dividers comprise supporting gussets.

14. The sports bottle in accordance with claim 13 wherein there are four supporting gussets and four chambers, each one in a right-angle sector extending from a mid-region beneath said peripheral wall lower portion to said sleeve.

* * * * *